United States Patent [19]

Boeshart

[11] Patent Number: 4,916,879

[45] Date of Patent: Apr. 17, 1990

[54] CORNER TIE

[76] Inventor: Patrick E. Boeshart, R.R. 1, Box 134, Sioux City, Iowa 51108

[21] Appl. No.: 408,610

[22] Filed: Sep. 18, 1989

[51] Int. Cl.[4] ..... E04C 1/00

[52] U.S. Cl. ..... 52/426; 52/309.12; 52/270; 52/309.11; 249/40

[58] Field of Search ..... 52/285, 286, 309.11, 52/426, 562, 563, 564, 698, 270, 271; 249/40

[56] References Cited

U.S. PATENT DOCUMENTS

| | | | |
|---|---|---|---|
| 836,245 | 11/1906 | Crawford | 52/270 X |
| 2,029,082 | 1/1936 | Odam | 52/426 X |
| 4,604,843 | 8/1986 | Ottetal | 52/309.12 X |
| 4,698,946 | 10/1987 | Wendt | 52/285 X |

*Primary Examiner*—Henry E. Raduazo
*Assistant Examiner*—Creighton Smith
*Attorney, Agent, or Firm*—Zarley, McKee, Thomte, Voorhees & Sease

[57] ABSTRACT

A corner tie includes an interior angular paddle and an exterior angular paddle connected and spaced apart by a central strap. Both angular paddles have a pair of leg portions extending from an angular bend, the leg portions of the two angular paddles being parallel. A second strap extends from the first leg of the interior angular paddle and projects outwardly at an acute angle with respect to the central strap. An outer paddle is mounted on the free end of the second strap so as to be coplanar with the first leg portion of the exterior angular paddle. A third strap extends from the second leg of the interior angular paddle and projects outwardly at an acute angle with respect to the central strap. A second outer paddle is mounted on the free end of the third strap so as to be coplanar with the second leg of the exterior angular paddle. A pair of inner angular paddles are mounted on the central strap intermediate the interior and exterior paddles. Sets of inner paddles are also mounted on the second and third straps such that form panels will be received between the inner paddle and outer paddles.

9 Claims, 3 Drawing Sheets

CORNER TIE

TECHNICAL FIELD

The present invention relates generally to ties for poured concrete wall systems, and more particularly to a corner tie which may be utilized to secure form panels in a corner so as to form a corner in a completed poured concrete wall.

BACKGROUND OF THE INVENTION

While wall forming systems have been in use for many years, a recent development in this industry is in the use of expanded polystyrene panels as forms for poured concrete walls. After the concrete has hardened, the panels may be left in place on the walls to serve as permanent insulation, or they may be stripped off to reveal the exposed concrete.

Upon introduction of this new wall forming system, it was found that it was unnecessary to use small "building blocks" to create the form panels to build a form system for receiving poured concrete. Rather, larger and larger panels are now being utilized to create the concrete forms. As the panels grew in size, the applicant herein devised a new type of tie, described in U.S. Pat. No. 4,765,109, which had special ends that could be "knocked off" to easily remove the large panels from the walls. While the patented tie has proved successful for its intended purpose, it was always necessary to utilize a special additional framing system to hold the form panels at the inner section of two walls, or at a corner where two walls meet.

It is therefore a general object of the present invention to provide a special corner tie for use with polystyrene panel-type forms on poured concrete walls.

Another object is to provide a concrete wall form tie which will rigidly hold the form panels necessary to pour a corner in a poured concrete wall.

A further object of the present invention is to provide a concrete wall form tie which will rigidly hold a series of form panels utilized in forming the intersection of two poured concrete walls.

Still another object is to provide a concrete wall form tie which has an end piece which is removable so as to allow the panels to be removed from the poured concrete wall.

These and other objects of the present invention will be apparent to those skilled in the art.

SUMMARY OF THE INVENTION

The corner tie of the present invention includes an interior angular paddle and an exterior angular paddle connected and spaced apart by a central strap. Both angular paddles have a pair of leg portions extending from an angular bend, the leg portions of the two angular paddles being parallel. A second strap extends from the first leg of the interior angular paddle and projects outwardly at an acute angle with respect to the central strap. An outer paddle is mounted on the free end of the second strap so as to be coplanar with the first leg portion of the exterior angular paddle. In this fashion, the outer paddle and the first leg of the exterior angular paddle will retain a form panel from moving outwardly. A third strap extends from the second leg of the interior angular paddle and projects outwardly at an acute angle with respect to the central strap. A second outer paddle is mounted on the free end of the third strap so as to be coplanar with the second leg of the exterior angular paddle. The second outer paddle and the second leg portion of the exterior angular paddle will retain a form panel so as to prevent outward movement of the form panel.

A pair of inner angular paddles are mounted on the central strap intermediate the interior and exterior paddles so as to retain the corners of a pair of intersecting form panels. Sets of inner paddles are also mounted on the second and third straps such that the form panels lie between the inner paddle and outer paddles and the inner paddle and interior or exterior angular paddles. In this way, paddle members are in contact with both sides of the form panels utilized to form a corner or intersection.

A pair of auxiliary straps extend from the central strap with one auxiliary strap parallel to the second strap and the other auxiliary strap parallel to the third strap. A pair of inner and outer paddles are mounted on each auxiliary strap to retain a form panel therebetween. The auxiliary straps are utilized on those occasions where a large wall thickness is necessary, so as to increase the strength of the corner tie.

DESCRIPTION OF THE PREFERRED EMBODIMENT

Figure 1:
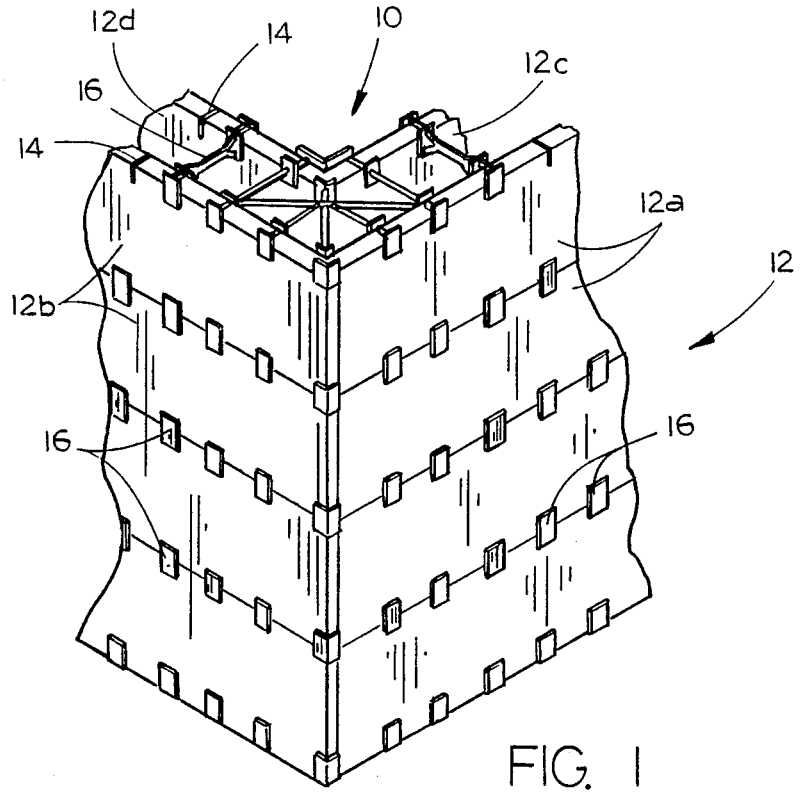
FIG. 1 is a pictorial view of a series of form panels intersecting at a corner, with the corner tie of the present invention installed thereon.

Referring now to the drawings, in which similar or corresponding parts are designated with the same reference numeral throughout the drawings, and more particularly to FIG. 1, the tie of the present invention is designated generally at 10 and is installed at the corner intersection of a plurality of wall form panels 12. For clarity, exterior wall panels 12 extending in one plane from the corner will be identified as panels 12*a*, exterior panels within the same plane and intersecting panels 12*a* will be identified as panels 12*b*, the interior panels parallel to exterior panels 12*a* will be identified as panels 12*c* and the interior panels parallel to panels 12*b* will be identified as panels 12*d*. Each of panels 12*a, b, c* and *d* have a plurality of uniformly spaced slots 14 cut in their upper and lower edges which will receive ties 16, such as those described in the applicant's U.S. Pat. No. 4,765,109.

Figure 2:
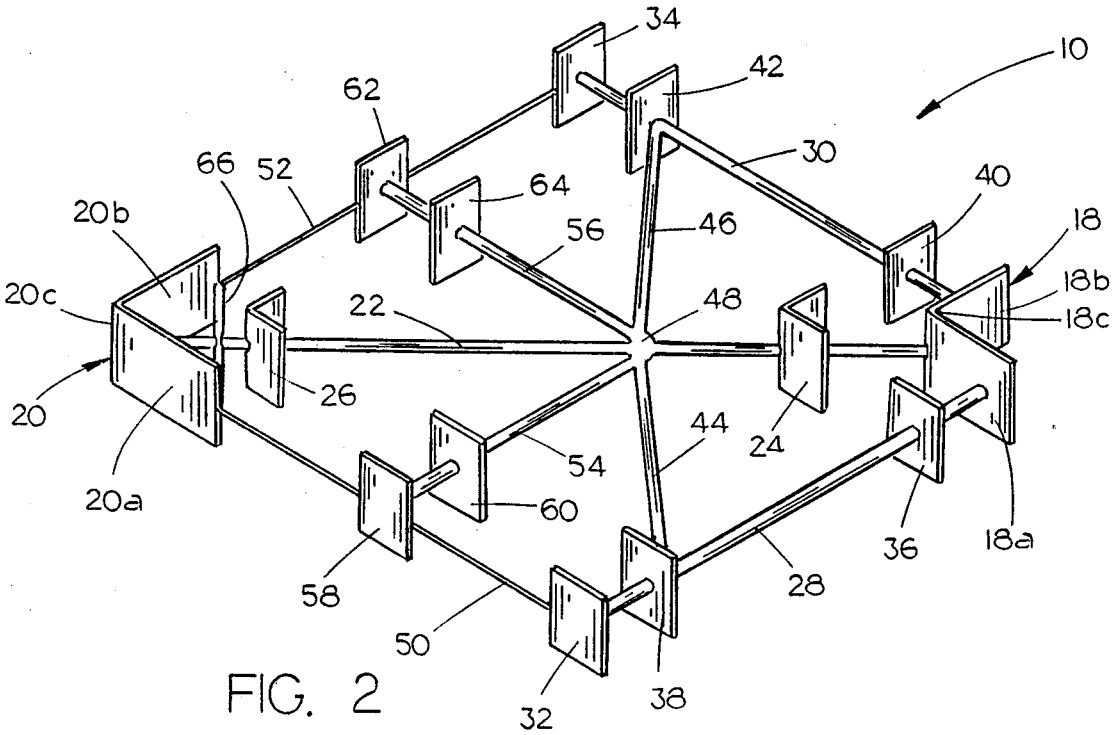
FIG. 2 is an enlarged perspective view of the tie of the present invention.
Figure 3:
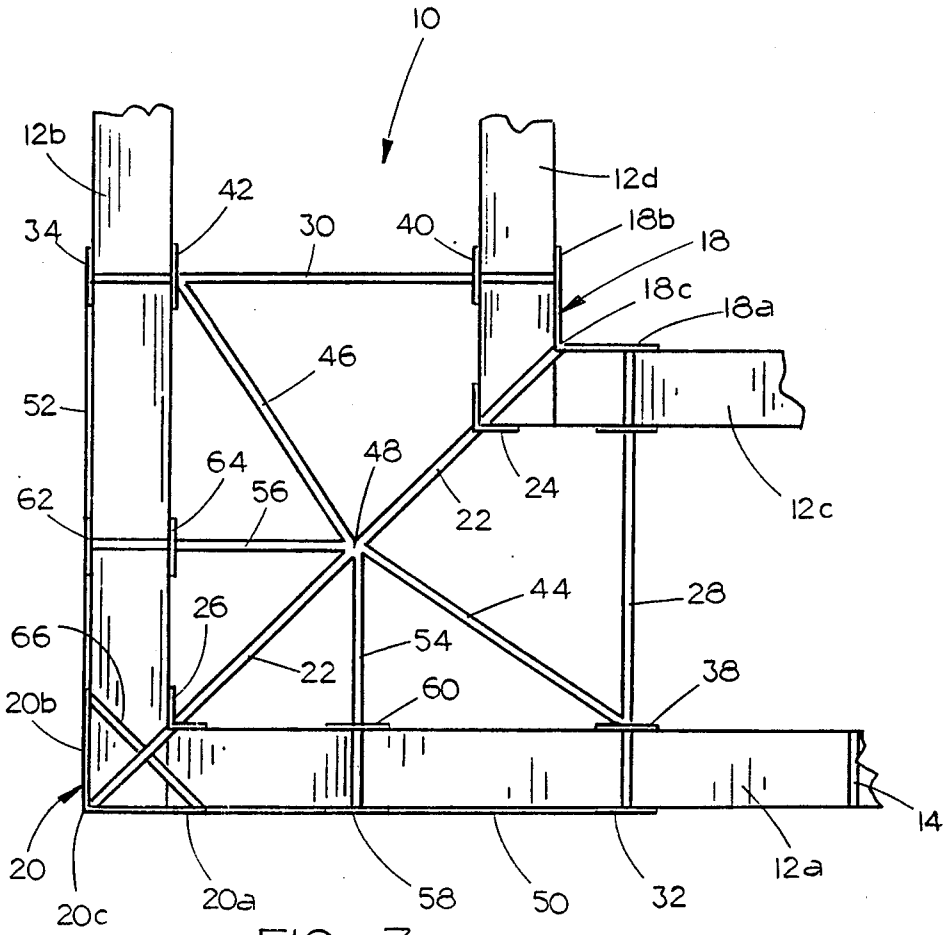
FIG. 3 is a top view of the corner shown in FIG. 1.

Referring now to FIGS. 2 and 3, corner tie 10 includes an interior angular paddle 18 and an exterior angular paddle 20 connected in parallel spaced-apart orientation by a central strap 22. The legs of interior and exterior angular paddles 18 and 20 are shown oriented at a 90° angle. However, the corner tie 10 of the present invention could be utilized at corners which have different angular orientations. For purposes of description, paddle members which abut inner panels 12*c* and 12*d* will be identified as interior paddles, and paddle members which abut outer panels 12*a* and 12*b* will be identified as exterior paddles. Furthermore, the interior and exterior paddles include sets of inner and outer interior paddles and sets of inner and outer exterior paddles, the "inner" direction being directed to the area in which the concrete wall will be poured and the "outer" direction being directed outwardly away from the concrete wall to be poured. Thus, angular paddle 18 is an outer interior paddle, and angular paddle 20 is an outer exterior paddle.

A pair of smaller angular paddles 24 and 26 are mounted on central strap 22 spaced inwardly from angular paddles 18 and 20 respectively. Inner angular paddle 24 is located so as to receive and retain the ends panel members 12*c* and 12*d* between angular paddle 18 and angular paddle 24 (see FIG. 3). Inner angular paddle 26 is located so as to receive the ends of panel members 12*a* and 12*b* between outer angular paddle 20 and inner angular paddle 26. As shown in the drawings, central strap 22 connects the angular bend 18*c* and 20*c* of paddles 18 and 20, and projects so as to bisect the angle formed between legs 18*a* and 18*b* of paddle 18 and legs 20*a* and 20*b* of paddle 20.

A second strap 28 projects perpendicularly from leg 18*a* of angular paddle 18, and a third strap 30 projects perpendicularly from leg 18*b* of angular paddle 18. Straps 28 and 30 have an outer exterior paddle 32 and 34 mounted at the opposite ends thereof to retain panels members 12*a* and 12*b*, respectively, in parallel relation with panels 12*c* and 12*d*, respectively. Second strap 28 has a pair of inner interior and exterior paddles mounted thereon parallel to leg 18*a* and paddle 32 and spaced a distance to hold the thickness of the respective panel members. Similarly, third strap 30 has a pair of inner interior and exterior paddles 40 and 42 located to hold panel members 12*b* and 12*d* in parallel relation. A pair of cross braces 44 and 46 extend from inner exterior paddles 38 and 42 to a junction point 48 on central strap 22. Cross braces 44 and 46 assist in maintaining straps 28 and 30 in the proper angular relationship. A thin connecting strand 50 extends from outer exterior paddle 32 to leg 20*a* of angular paddle 20, and a similar connecting strand 52 extends from exterior outer paddle 34 to leg 20*b* of angular paddle 20, and serve to hold outer paddles 32 and 34 in appropriate relationship to angular paddle 20.

A pair of auxiliary straps 54 and 56 extend from juncture 48 parallel to straps 28 and 30, respectively, and are connected to connecting strands 50 and 52, respectively. Auxiliary strap 54 has an outer exterior paddle 58 and an inner exterior paddle 60 mounted thereon and adapted to receive a panel 12*a* therebetween. Similarly, strap 56 has an outer exterior paddle 62 and inner exterior paddle 64 mounted thereon adapted to receive a panel 12*b* therebetween. Preferably, the spacing between strap 28, strap 54 and connecting strand 52 is uniform and equal to the spacing of slots 14 in the panels 12. Similarly, the spacing of strap 30, auxiliary strap 56 and connecting strand 50 is uniform so as to also match the spacing of slots 14 in panels 12. In order to add additional strength to the corner where panels 12*a* and 12*b* meet, a small cross brace 66 is mounted between legs 20*a* and 20*b* and attached to center strap 22.

In use, as each course of panels 12 are installed and connected utilizing conventional ties 16, the panels 12 will be cut to the appropriate length to meet at a desired corner. In the vast majority of cases, the length of the panels will be such that the ends of the panels are aligned along a series of vertical slots 14 and will be modular and aligned with the uniform spacing of the slots. Thus, the spacing of the straps of the corner tie will be directly associated with the spacing of the slots in the panels. At each corner, an additional diagonal slot must be cut into the inner and outer panels so as to receive center strap 22 of corner tie 10. Similarly, a second diagonal slot is cut in the outer panels so as to receive cross member 66 of exterior angular panel 20. However, because panels 12 are of a polystyrene material, such custom cuts are quickly and easily formed in the panels. Since corner tie 10 firmly holds the panels in position, no special bracing is necessary on the outside of panels 12 at the corners.

It is also possible to completely remove an angular portion of the ends of panels 12, such that cross brace 66 abuts the outer surface of the angular cuts. The strength of the tie will prevent separation of the panel ends even under such stressful conditions.

Figure 4:
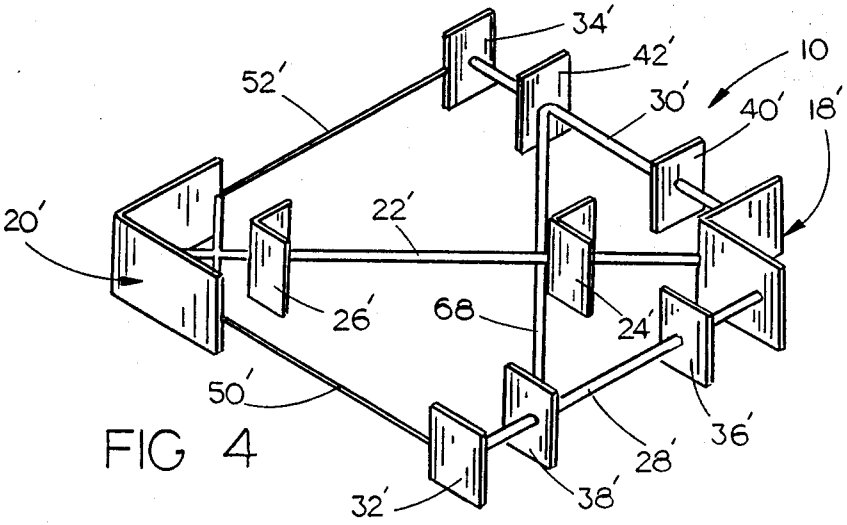
FIG. 4 is a second embodiment of the present invention.
Figure 5:
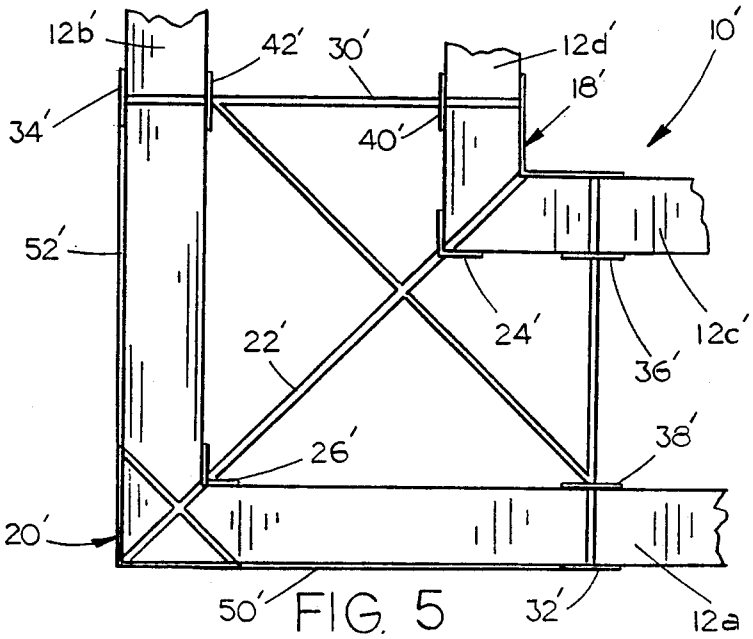
FIG. 5 is a top view of the second embodiment of the invention installed on a corner of a form panel system.

A second embodiment of the invention is designated generally at 10' in FIGS. 4 and 5. Corner tie 10' is merely a smaller version of the first embodiment of corner tie 10, for use in instances where the poured concrete wall will be approximately 4 inches or less in width. Thus, the interior and exterior angular paddles 18' and 20' are connected to a central strap 22' in a fashion similar to the first embodiment. Similarly, second and third straps 28' and 30' project from the legs of angular paddle 18' and have paddles 36', 38' and 32', and paddles 40', 42' and 34' mounted thereon so as to receive panels in a fashion similar to the first embodiment. Because the width of the wall is much narrower, auxiliary straps 54 and 56 of the first embodiment are not necessary in corner tie 10' of the second embodiment. Therefore, a single cross member 68 connects straps 28' and 30' to central strap 22'. Connecting strands 50' and 52' are additionally utilized to maintain the appropriate angular orientation between straps 28' and 30' at their outer ends.

Figure 8:
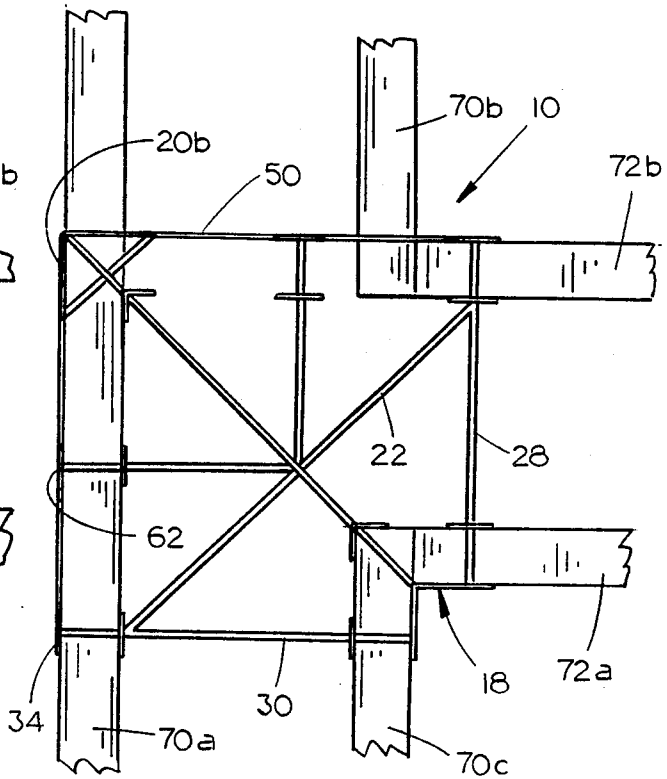
FIG. 8 is a sectional view taken at lines 8—8 in FIG. 6.
Figure 7:
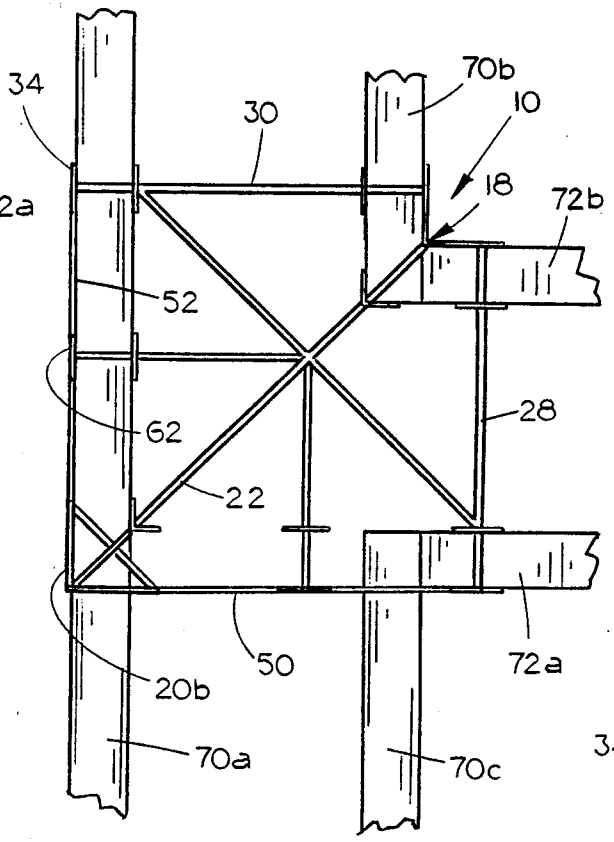
FIG. 7 is a sectional view taken at lines 7—7 in FIG. 6.
Figure 6:
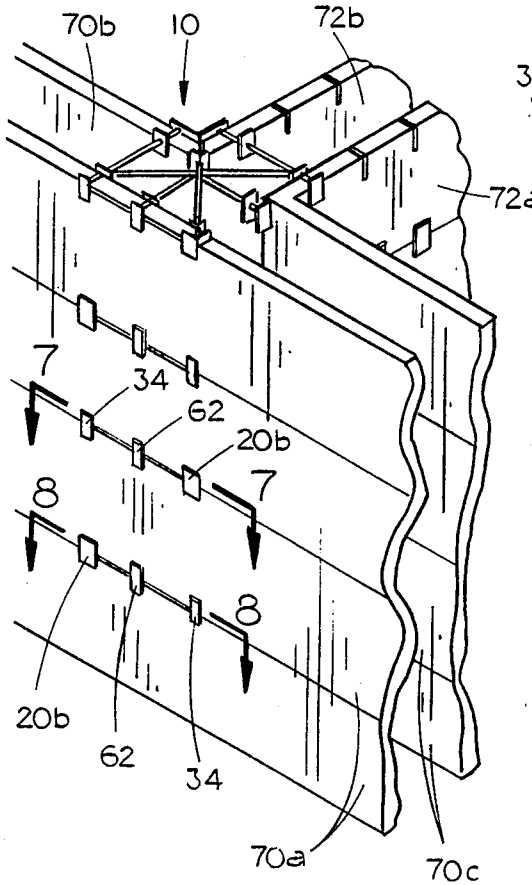
FIG. 6 is a pictorial view of the tie of FIG. 2 installed at the intersection of two walls.

Referring now to FIGS. 6–8, corner tie 10 is utilized in a situation where an interior wall will intersect an exterior wall at a T-type intersection. In order to aid in the description of the use of tie 10 in this situation, the panels utilized to form the exterior wall will be identified as 70, and include outer panels 70a and inner panels 70*b* and 70*c*. Inner panels 70*b* and 70*c* lie within the same plane and are spaced apart such that the interior wall will be formed integrally with the exterior wall. The interior wall is formed utilizing panels 72*a* and 72*b* oriented in spaced apart parallel relationship. To further simplify the drawings, all additional ties have been omitted so that only corner ties 10 are shown in their various orientations.

As each course of panels 70*a*, 70*b* and 70*c*, and panels 72*a* and 72*b* are arranged and connected utilizing conventional ties, a corner tie 10 is mounted with paddles 34, 62 and leg 20*b* of angular paddle 20 oriented outwardly, to hold panels 70*a*. Thus, FIG. 8 shows the orientation of one corner tie with strap 28 extending between panels 72*a* and 72*b*, strap 30 extending between panels 70*a* and 70*c*, and web 50 extending between panels 70*a* and 70*b*. Corner tie 10 therefore firmly holds panels 70*a*, 70*c*, 72*a* and 72*b* in the desired position. In the next course of panels, corner tie 10 is flipped over, as shown in FIG. 7, so that paddles 34, 62 and leg 20*b* again extend outwardly from panels 70*a*, with paddle 34 vertically aligned above leg 20*b*, paddle 62 aligned above the lower paddle 62 and leg 20*b* vertically aligned above paddle 34 of the next lower corner tie 10.

FIG. 7 shows the orientation of corner tie 10 in the subsequent course. In this orientation it can be seen that strap 28 continues to hold panels 72*a* and 72*b* in aligned condition, but the positions of strap 30 and connecting strand 50 are reversed. Strap 30 thereby connects exterior panels 70*a* to inner panels 70*b* of the exterior wall, and connecting strand 50 extends between panels 70*a* and 70*c*. Custom cutting of additional slots to receive the straps of corner tie 10 is necessary, but is quickly and easily accomplished. Continually alternating the position of corner tie 10 allows panels 72*a* and 72*b* of the interior wall to be firmly positioned with respect to panels 70*a*, 70*b* and 70*c* of the exterior wall, so as to receive poured concrete.

Although wall panels 70*b* and 70*c* are not specifically retained in position by the corner tie at the corner on alternating courses, this lack of additional support has been found to be unnecessary in this specific situation. One reason for this is the fact that additional conventional ties connect panels 70*a* with panels 70*b* and 70*c*. Furthermore, as concrete is poured between all of the form panels, the pressure of the concrete forces the panels outwardly, and thereby forces panels 70*b* and 70*c* against the ends of panels 72*a* and 72*b* to form a tight fit.

Whereas the invention has been shown and described in connection with the preferred embodiments thereof, it will be understood that many modifications, substitutions and additions may be made which are within the intended broad scope of the appended claims. For example, the spacing of parallel straps 30, 56 and connecting strand 50, as well as straps 28, 54 and connecting strand 52 may be altered to fit the slot arrangement of the desired panel system. The slot arrangement of the desired panel system may be uniform or otherwise. Similarly, the corner tie shown is utilized to form a 90° corner and the intersection of an interior wall perpendicularly with an exterior wall. This angular relationship may be changed so as to form oblique or acute angles without departing from the intended spirit of the invention.

There has therefore been shown and described an improved corner tie which accomplishes at least all of the above stated objects.

I claim:

1. A tie for interlocking the ends of parallel, spaced-apart form panels which intersect a second pair of parallel, spaced-apart form panels, comprising:

an interior angular paddle and an exterior angular paddle connected by a central strap means, said interior and exterior angular paddles each having first and second leg portions connected at an angular bend;

said interior and exterior angular paddles being connected to said central strap means such that said first leg portions are parallel, and said second leg portions are parallel;

second strap means having one, end mounted on the first leg portion of said interior angular paddle and extending outwardly therefrom at an acute angle with respect to said central strap means;

an outer paddle mounted on the free end of said second strap means coplanar with the first leg portion of said exterior angular paddle;

third strap means having one end mounted on the second leg portion of said interior angular paddle and extending outwardly therefrom at an acute angle with respect to said central strap means;

a second outer paddle mounted on the free end of said third strap means coplanar with the second leg portion of said exterior angular paddle.

2. The tie of claim 1, further comprising means connecting said central, second and third strap means for retaining said strap means in fixed relation to one another.

3. The tie of claim 1, further comprising a cross-member extending between said second and third strap means, and connected to said central strap means, for retaining said strap means in fixed relation to one another.

4. The tie of claim 1, further comprising a first elongated strand connecting said first outer paddle to said first leg portion of said exterior angular paddle, and a second elongated strand connecting said second outer paddle to said second leg portion of said exterior angular paddle, for retaining said strap means in fixed relation to one another.

5. The tie of claim 1, further comprising:

first means connected to said second strap means for retaining a form panel in abutting contact with said first leg portion of said interior angular paddle;

second means connected to said second strap means for retaining a form panel in abutting contact with said first outer paddle;

third means connected to said third strap means for retaining a form panel in abutting contact with said second leg portion of said interior angular paddle; and fourth means connected to said third strap means for retaining a form panel in abutting contact with said second outer paddle.

6. The tie of claim 5, wherein said first, second, third and fourth means connected to said second and third strap means are paddle members mounted on said second and third straps.

7. The tie of claim 1, further comprising:

an inner interior angular paddle mounted on said central strap means adjacent to and spaced from said interior angular paddle, for retaining a form panel against said interior angular paddle; and an inner exterior angular paddle mounted on said central strap means adjacent to and spaced from said exterior angular paddle for retaining a form panel against said exterior angular paddle.

8. The tie of claim 1, further comprising:

a first auxiliary strap means extending from said central strap means, parallel to said second strap means;

a third outer paddle mounted on the free end of said first auxiliary strap means coplanar with said first outer paddle;

a second auxiliary strap means extending from said central strap, parallel to said third strap means; and a fourth outer paddle mounted on the free end of said second auxiliary strap means coplanar with said second outer paddle.

9. The tie of claim 8, further comprising:

an elongated strand extending in opposite directions from said third outer paddle to said first outer paddle and said first leg portion of the exterior angular paddle; and an elongated strand extending in opposite directions from said fourth outer paddle to said second outer paddle and said second leg portion of the exterior angular paddle, for retaining all of said strap means in fixed relation with one another.

* * * * *